US005415796A

United States Patent [19]

van Buskirk et al.

[11] Patent Number: 5,415,796

[45] Date of Patent: May 16, 1995

[54] LIQUID NONAQUEOUS DETERGENT WITH STABLE, SOLUBILIZED PERACID

[75] Inventors: Gregory van Buskirk, Danville; Donna L. Tavares, Tracy; Thomas B. Ottoboni, Belmont, all of Calif.

[73] Assignee: The Clorox Company, Oakland, Calif.

[21] Appl. No.: 959,505

[22] Filed: Oct. 9, 1992

Related U.S. Application Data

[63] Continuation of Ser. No. 608,459, Nov. 2, 1990, abandoned.

[51] Int. Cl.[6] ..... C11D 1/66; C11D 3/28; C11D 3/39; C11D 3/395

[52] U.S. Cl. ..... 252/95; 252/546; 252/542; 252/156; 252/174.21; 252/174.23; 252/174.12; 252/DIG. 14

[58] Field of Search ..... 252/95, 542, 546, 153, 252/174.21, 174.23, 174.12, DIG. 14

[56] References Cited

U.S. PATENT DOCUMENTS

| | | | |
|---|---|---|---|
| 3,130,169 | 4/1964 | Blumbergs | 252/186 |
| 3,850,831 | 11/1974 | Hellsten et al. | 252/99 |
| 3,956,159 | 5/1976 | Jones | 252/104 |
| 4,017,412 | 4/1977 | Bradley | 252/186 |
| 4,090,973 | 5/1978 | Maguire | 252/135 |
| 4,199,466 | 4/1980 | Benson | 252/95 |
| 4,316,812 | 2/1982 | Hancock et al. | 252/99 |
| 4,537,706 | 8/1985 | Severson, Jr. | 252/174.12 |
| 4,539,007 | 0/0000 | Rosch et al. . | |
| 4,606,838 | 8/1986 | Burns | 252/95 |
| 4,671,891 | 6/1987 | Hartman | 252/102 |
| 4,801,544 | 1/1989 | Munk | 252/174.12 |
| 4,874,537 | 10/1989 | Peterson | 252/99 |
| 4,923,631 | 5/1990 | Sims | 252/102 |
| 4,929,377 | 5/1990 | Emmons | 251/100 |
| 4,981,606 | 1/1991 | Barnes | 252/95 |
| 4,992,194 | 2/1991 | Van de Pas et al. | 252/99 |
| 5,061,807 | 10/1991 | Gethoeffer et al. | 548/473 |
| 5,071,584 | 12/1991 | Venturello et al. | 252/102 |
| 5,073,285 | 12/1991 | Liberati et al. | 252/94 |

FOREIGN PATENT DOCUMENTS

| | | | |
|---|---|---|---|
| 92932 | 11/1983 | European Pat. Off. | C11D 3/39 |
| 94656 | 11/1983 | European Pat. Off. | D06L 1/14 |
| 325288 | 7/1989 | European Pat. Off. | C07D 209/48 |
| 325289 | 7/1989 | European Pat. Off. | D06L 3/02 |
| 340000 | 11/1989 | European Pat. Off. | C11D 3/39 |
| 373613 | 6/1990 | European Pat. Off. | C07O 213/78 |
| 376360 | 7/1990 | European Pat. Off. . | |
| 399752 | 11/1990 | European Pat. Off. . | |
| 435379 | 3/1991 | European Pat. Off. | C11D 3/39 |
| 442549 | 8/1991 | European Pat. Off. | C11D 3/39 |
| 443640 | 8/1991 | European Pat. Off. | C11D 3/39 |
| 3823172 | 1/1990 | Germany . | |
| 3906768 | 9/1990 | Germany | C07D 209/48 |
| 2182051 | 5/1987 | United Kingdom | C11D 3/12 |
| 9007501 | 7/1990 | WIPO . | |
| 90/15857 | 12/1990 | WIPO | C11D 3/39 |

OTHER PUBLICATIONS

H. Gethoeffer et al., New Developments in the Field of Imidoperoxidcarboxylic Acids, a Paper presented at the 1990 AOCS Meeting, Baltimore, Md.
Hoechst Product Data PAP (1988).
Hoechst Material Safety Data Sheet PAP (1988).
Hoechst, PAP data (1988).

*Primary Examiner*—Paul Lieberman
*Assistant Examiner*—Erin M. Higgins

[57] ABSTRACT

The invention provides a stable, liquid, substantially nonaqueous detergent comprising:

at least one imidoperacid with the structure

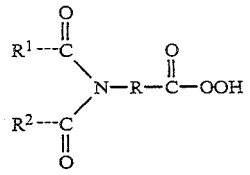

wherein R is $C_{1-20}$ alkylene, $R^1$ and $R^2$ are individually H or $C_{1-6}$ alkyl or alkenyl, or $R^1$ and $R^2$ join to form a heterocycle, said imidoperacid being solubilized in a liquid nonionic surfactant. The stable liquid detergent has excellent oxidant and phase stability and, if enzymes are present, maintains proficient enzyme activity.

24 Claims, No Drawings

LIQUID NONAQUEOUS DETERGENT WITH STABLE, SOLUBILIZED PERACID

Continuation of U.S. Ser. No. 07/608,459, filed Nov. 2, 1990, now abandoned.

BACKGROUND OF THE INVENTION

1. Field of the Invention

This invention relates to phase stable, liquid nonaqueous detergents, which contains a stable, solubilized imidoperacid.

2. Brief Description of the Prior Art

There is a need for liquid detergents containing stable oxidants therein. While some aqueous liquid detergents can include oxidants, because their formulations principally consist of water, the amount of active actually delivered is relatively low (See, e.g., Franks, U.S. Pat. No. 4,430,236, published European Patent Applications EP 294,904 and EP 293,040). Moreover, because of the water, there are always concerns with oxidant stability, due to solution decomposition, hydrolysis, or the like, and, if enzymes are present, with enzyme stability as well.

To enhance the bleaching action of liquid hydrogen peroxide, Mitchell et al., U.S. Pat. No. 4,772,290, and Farr et al., U.S. Pat. No. 4,900,469, suggest the use of various peracid precursors, including maleimide-substituted acyloxy esters, for inclusion in such liquid hydrogen peroxide bleach compositions, which precursors would be insoluble at neutral or acidic pH, but soluble in alkaline pH.

Nonaqueous liquid detergents present interesting possibilities for the inclusion of oxidants.

Hancock et al., U.S. Pat. No. 4,316,812, discloses a liquid, nonaqueous detergent comprising a dispersion of solids in a liquid nonionic surfactant having a pour point of less than 10° C., in which the solids comprise builders and an oxygen bleach, and there is allegedly no dispersant for the solids. However, Hancock apparently does require a dispersant which is either a finely divided silica (Aerosil), a polyethylene glycol, or both (Cf. Examples 1, 2 and 5 of Hancock).

Peterson et al., U.S. Pat. No. 4,874,537, discloses stable, liquid nonaqueous detergents comprising a solids portion stably suspended in a liquids portion which is mostly nonionic surfactant, by means of sulfonated, lower alkylated condensed ring aryl stabilizers. The formulation can include various oxidants.

However, none of the art discloses, teaches or suggests that imidoperacids can be solubilized in a liquid phase comprising nonionic surfactants to result in a liquid oxidant detergent which unexpectedly has both excellent oxidant and phase stability.

Furthermore, none of the art teaches, discloses or suggests that such liquid oxidant detergents containing solubilized imidoperacids can include enzymes without enzyme stabilizers, yet retain excellent enzyme activity.

SUMMARY OF THE INVENTION AND OBJECTS

The invention comprises, in one embodiment, a stable, liquid, substantially nonaqueous detergent comprising:

at least one imidoperacid with the structure

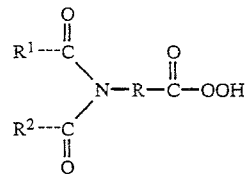

wherein R is $C_{1-20}$ alkylene, $R^1$ and $R^2$ are individually H or $C_{1-6}$ alkyl or alkenyl, or $R^1$ and $R^2$ join to form a heterocycle, said imidoperacid being solubilized in a liquid nonionic surfactant.

It is therefore an object of this invention to provide a phase stable liquid, substantially nonaqueous detergent with an imidoperacid solubilized in the nonaqueous phase thereof.

It is a further object of this invention to provide a liquid, substantially nonaqueous detergent containing a solubilized imidoperacid which has prolonged physical and chemical stability despite extended storage and elevated temperatures.

It is yet a further object of this invention to provide a liquid, substantially nonaqueous detergent containing a solubilized imidoperacid which can contain enzymes therein which retain significant enzyme activity despite the presence of the imidoperacid oxidant.

It is a still further object of this invention to provide a liquid, substantially nonaqueous detergent containing a solubilized imidoperacid containing enzymes stably suspended in the liquid phase by means of the combination of an alkanolamine, especially triethanolamine, and a water soluble or dispersible polymer, especially polyethylene glycol.

DETAILED DESCRIPTION OF THE PREFERRED EMBODIMENTS

As mentioned above, the present invention provides a stable, liquid nonaqueous detergent, with an imidoperacid solubilized in the nonaqueous phase thereof. Further standard detergent adjuncts, especially enzymes, can be present in these compositions.

Liquid detergents are desirable alternatives to dry, granular detergent products. While dry, granular detergents have found wide consumer acceptance, liquid products can be adapted to a wide variety of uses. For example, liquid products can be directly applied to stains and dirty spots on fabrics, without being predissolved in water or other fluid media. Further, a "stream" of liquid detergent can be more easily directed to a targeted location in the wash water or clothing than a dry, granular product.

In the present invention, the liquids portion comprises a substantially nonaqueous phase composed of nonionic surfactants, and an imidoperacid is stably solubilized therein. The nonaqueous liquid phase may additionally suspend a solids portion comprising such detergent adjuncts as builders and buffers, as well as other solid adjuncts. However, in order to maintain fluidity, the nonionic surfactant would be present in a substantial excess to the solids portion.

It has not been hitherto disclosed, taught or suggested by the prior art that the imidoperacids of the invention could be solubilized in a liquid, nonaqueous phase comprising mostly nonionic surfactant. Indeed, various references have discussed liquid systems containing oxidants, either with peracids suspended in a network of solvents (Jones, U.S. Pat. No. 3,956,159, Blumbergs, U.S. Pat. No. 3,130,169) or peracids or bleach activators suspended in a liquid matrix along with additives which impair their solubility (EP 92,932, Bradley, U.S. Pat. No. 4,017,412, Rosch et al., U.S. Pat. No. 4,539,007, Benson, Jr., U.S. Pat. No. 4,199,466). None of these references, however, disclose imidoperacids and none teach, suggest or disclose the solubilization of such imidoperacids in nonaqueous liquid detergent.

In the following description, the components of the invention are described.

1. Liquid Phase

The liquid phase comprises substantially only liquid, nonionic surfactant, although amounts of some other liquids, such as solvents, liquid hydrotropes, and the like may also be present. The presence of other liquids are less preferred, since they may drive up the costs of materials in these formulations, could require extra processing steps, and might result in the inclusion of large amounts of non-detergency active ingredients. Additionally, trends in regulatory laws may restrict the amount of solvents and other organic materials in cleaning compositions because of possible deleterious health or environmental effects.

The nonionic surfactant present in the invention will preferably have a pour point of less than about 40° C., more preferably less than 30° C., and most preferably below 25° C. They will have an HLB (hydrophile-lipophile balance) of between 2 and 16, more preferably between 4 and 14, and most preferably between 9 and 12. However, mixtures of lower HLB surfactants with higher HLB surfactants can be present as the liquid portion of the detergent, the resulting HLB usually being an average of the two or more surfactants. Additionally, the pour points of the mixtures can be, but are not necessarily, weighted averages of the surfactants used.

The nonionic surfactants are preferably selected from the group consisting of $C_{6-18}$ alcohols with 1–15 moles of ethylene oxide per mole of alcohol, $C_{6-18}$ alcohols with 1–10 moles of propylene oxide per mole of alcohol, $C_{6-18}$ alcohols with 1–15 moles of ethylene oxide and 1–10 moles of propylene oxide per mole of alcohol, $C_{6-18}$ alkylphenols, with 1–15 moles of ethylene oxide or propylene oxide or both, and mixtures of any of the foregoing. Certain suitable surfactants are available from Shell Chemical Company under the trademark Neodol. Suitable surfactants include Neodol 1-5 ($C_{11}$ alcohol with an average of 5 moles of ethylene oxide per mole of alcohol), Neodol 23-6.5 ($C_{12-13}$ alcohol with an average 6.5 moles of ethylene oxide per mole of alcohol), Neodol 25-9 ($C_{12-15}$ alcohol with an average 9 moles of ethylene oxide per mole of alcohol) and Neodol 25-3 ($C_{12-15}$ alcohol with an average 3 moles of ethylene oxide per mole of alcohol). These and other nonionic surfactants used in the invention can be either linear or branched, or primary or secondary alcohols. If these surfactants are partially unsaturated, they can vary from $C_{10-22}$ alkoxylated alcohols, with a minimum iodine value of at least 40, such as exemplified by Drozd et al., U.S. Pat. No. 4,668,423, which is incorporated herein by reference. If the surfactants are partially propoxylated, they can vary from propoxylated $C_{8-24}$ alcohols. An example of an ethoxylated propoxylated alcohol is Surfonic JL-80X ($C_{9-11}$ alcohol with about 9 moles of ethylene oxide and 1.5 moles of propylene oxide per mole of alcohol).

Other suitable nonionic surfactants may include polyoxyethylene carboxylic acid esters, fatty acid glycerol esters, fatty acid and ethoxylated fatty acid alkanolamides, certain block copolymers of propylene oxide and ethylene oxide and block polymers of propylene oxide and ethylene oxide with propoxylated ethylene diamine (or some other suitable initiator). Still further, such semi-polar nonionic surfactants as amine oxides, phosphine oxides, sulfoxides and their ethoxylated derivatives, may be suitable for use herein.

Nonionic surfactants are especially preferred for use in this invention since they are generally found in liquid form, usually contain 100% active content, possess little water, and are particularly effective at removing oily soils, such as sebum and glycerides.

2. The Imidoperacid

It is, of course, desirable to include an oxidant in detergent formulations in order to oxidize oxidizable stains and soils. Accordingly, many dry detergent formulations (e.g., Coyne et al., U.S. Pat. No. 4,863,626, Fong et al., U.S. Pat. No. 4,778,618) utilize organic peracids or a peroxide source, such as sodium perborate with a bleach activator therefor and, apart from the possible need to monitor residual moisture in cartons containing such formulations, there usually is no concern of premature decomposition or hydrolysis of the oxidants.

In contrast, where the oxidant is placed in a liquid formulation, there is great concern about maintaining the oxidant stability of the oxidant. Decomposition of the oxidant could also result in detrimental effects to other sensitive actives, such as enzymes, dyes and fluorescent whitening agents. Hydrolysis of organic activators can also reduce the effectiveness of such activators. As discussed above, some solutions to the problem of maintaining oxidant stability were to use nonaqueous systems comprising mostly solvents, or to insolubilize the organic oxidant or bleach activator and suspend it in a liquid medium.

Applicants have surprisingly found that imidoperacids of the structure below can be solubilized in a substantially nonaqueous phase comprising liquid nonionic surfactant:

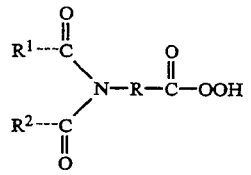

wherein R is $C_{1-20}$ alkylene, $R^1$ and $R^2$ are individually H or $C_{1-6}$ alkyl or alkenyl, or $R^1$ and $R^2$ join to form a heterocycle. Additionally, R, $R^1$ $R^2$, or the other R radicals described herein, may be substituted with various functional substituents, such as OH, halogen (CI, I, Br), $SO_3M$ (wherein M is H, or an alkali metal, alkaline earth, or ammonium counterion), $SO_4M$, $NO_3M$, acyl, carboxyl, and the like. When $R^1$ and $R^2$ are methylene and are joined to form a heterocycle, the resulting peracids can be named succinimidoperacids.

It is preferred when $R^1$ and $R^2$ join to form a heterocycle. Then, compounds of the structure below result:

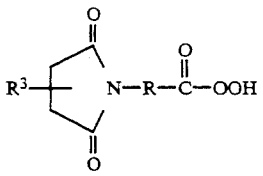

wherein $R^3$ can be at least one aromatic ring fused to the heterocycle, or $C_{1-20}$ alkyl or alkenyl.

It is also preferred when $R^3$ is an aromatic ring fused to the heterocycle formed by the joining of $R^1$ and $R^2$. Then, when one six member aromatic ring is so condensed with the imide nucleus, a phthalimidoperacid results.

Especially preferred compounds include

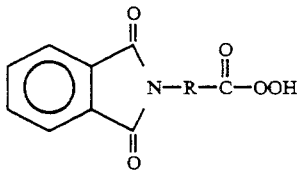

wherein R is $C_{1-15}$ alkylene. Exemplary compounds include phthalimidoperacetic acid ($R=CH_2$), phthalimidopercaproic acid ($R=[CH_2]_5$) and phthalimidoperdodecanoic acid ($R=[CH_2]_{11}$).

In the present invention, proficient oxidant and phase stability were attained using phthalimido-percaproic acid. Its structure is depicted below:

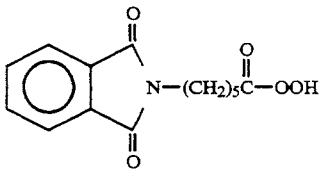

The synthesis of these compounds can be found in published European Patent Applications EP 325,288 and EP 325,289 (assigned to Ausimont S.r.l., Milan, Italy), both of which are incorporated herein by reference thereto. Another supplier of such compounds is Hoechst A. G., Frankfurt, Federal Republic of Germany, whose researchers, Gethoeffer et al., published a paper "New Developments in the Field of Imidoperoxicarboxylic Acids" (1990), which disclosure is incorporated herein by reference.

These imidoperacids demonstrate excellent phase and oxidant stability in the nonaqueous liquids of the present invention. By the term "phase stable," applicants mean that the liquid is a clear, isotropic solution, which does not phase separate, or suffer significant syneresis greater than about 40%, more preferably greater than about 35%, and most preferably, greater than about 30% after storage. By "oxidant stable," applicants mean that greater than about 75% of the original active oxygen (A.O.), more preferably greater than about 80% and most preferably greater than about 85%, is maintained despite longterm storage.

Further, when enzymes are incorporated in the present invention,surprisingly favorable enzyme stability is achieved. By enzyme stability, applicants mean that preferably greater than 50%, more preferably greater than 55% and most preferably greater than 60% of the original enzyme activity is maintained despite longterm storage.

It is preferred that the imidoperacid be present in an amount sufficient to provide 0.01–100ppm A.O., more preferably 0.01–50ppm A.O., and most preferably 0.05–30ppm A.O. in the wash solution. Active oxygen can be calculated as demonstrated in Lewis, "Peracid and Peroxide Oxidations", in *Oxidation* (Marcel Dekker, 1969).

3. Solids Portion

The solids portion of the invention, as previously mentioned, substantially comprises alkaline builders, and other adjuncts which are granular or particulate in nature, such as enzymes and pigments. If additional oxidants are desired, however, inorganic and organic oxidants could possibly be included.

The builders are typically alkaline builders, i.e., those which in aqueous solution will attain a pH of 7–14, preferably 8–10. Examples of inorganic builders include the alkali metal and ammonium carbonates (including sesquicarbonates and bicarbonates), silicates (including polysilicates and metasilicates), phosphates (including orthophosphates, tripolyphosphates and tetrapyrophosphates), aluminosilicates (both natural and synthetic zeolites), and mixtures thereof. Carbonates are especially desirable for use in this invention because of their high alkalinity and effectiveness in sequestering heavy metals which may be present in hard water, as well as their low cost.

Organic builders are also suitable for use, and are selected from the group consisting of the alkali metal and ammonium sulfosuccinates, polyacrylates, polymaleates, copolymers of acrylic acid and maleic acid or maleic anhydride, nitrilotriacetic acid, ethylenediaminetetraacetic acid, citrates and mixtures thereof.

The additional oxidants can include inorganic and organic oxidants. The inorganic oxidants generally comprise materials which, in aqueous solution, provide hydrogen peroxide. These include, preferably, the alkali metal percarbonates, perborates (both perborate monohydrate and perborate tetrahydrate), and hydrogen peroxide adducts. Other peroxygen sources may be possible, such as monopersulfates and monoperphosphates and inorganic peroxides (See, e.g., Gray et al., U.S. Pat. No. 4,891,147, which is incorporated herein by reference). It may also be possible to use organic oxidants, e.g., organic peroxides and organic peracids. Examples of applicable peracids may include hydrotropic peracids (e.gs., Johnston, U.S. Pat. No. 4,100,095, and Coyne et al., U.S. Pat. No. 4,863,626 , both of which are incorporated herein by reference) and surface active or hydrophobic peracids (e.gs., Hsieh et al., U.S. Pat. No. 4,655,789, and Bossu, U.S. Pat. No. 4,391,725, both of which are incorporated herein by reference).

3. Characteristics of the Liquid Detergent

It is preferred that the invention comprise about 20–100% of the liquid portion, and 0–50% of the solids portion stably suspended therein, said 0–50% of solids comprising substantially all builder, oxidants and other adjuncts described herein. More preferably, 20–30% of the builder is present, most preferably 22–28% builder. However, the ratio of liquids portion to solids portion will generally range from about 20:1 to 1:1, more preferably at least 10:1 to 1:1. The imidoperacid, once solubilized, forms a part of the liquid phase. However, as a part of the entire composition, it is preferred that it be present in an amount from about 0.1–50%, more preferably 0.2–40% and most preferably 0.5–30% of the composition.

The solids portion should generally have a particle size between 1–50 microns, more preferably between 1–30 microns, and most preferably between 1–25 microns, average particle size. Although many suppliers of these solids can provide a range of particle size, the desired particle size can also be obtained by using ball mills or grinders.

This liquid detergent is a Newtonian liquid. The present invention has a preferable viscosity of about 1–2,000 centipoises (CPS), more preferably 5–2,000 CPS, and most preferably 10–1,000 CPS.

It is preferred that water not be present in the invention except in minute or trace amounts (through introduction of various ingredients). Water is a potential problem in these sorts of detergents since extraneous water from sources such as condensation in an area where the detergent container is stored (especially where there are temperature fluctuations), or high humidity, or where the user deliberately or accidentally adds water to the container, e.g., while rinsing the container closure or the bottle. This latter category is especially prevalent when the closure is used as a measuring device, and the user rinses the closure before recombining it with the container.

4. Additional Surfactants

It appears preferred to include additional surfactants in the liquid detergents of this invention. While nonionic surfactants are quite effective at oily and greasy soil removal (e.g., sebum), particulate soils, such as clay soils and the like, may be more effectively removed by anionic surfactants. These preferred anionic surfactants are generally selected from anionic sulfates and sulfonates. Non-limiting examples are $C_{6-18}$ alkyl aryl sulfonates; $C_{6-18}$ alkyl ether sulfates (which contain 1–10 moles of ethylene oxide per mole of alcohol, exemplary of which is Neodol 25-3S, Shell Chemical Company; $C_{8-18}$ alkyl sulfosuccinates, e.g., Aerosol OT, American Cyanamid; $C_{8-18}$ alkyl sulfates; secondary alkane (paraffin) sulfonates, e.g., Hostapur SAS, Farbwerke Hoechst A. G.; alpha-olefin sulfonates; and alkylated diphenyl oxide disulfonates, e.g., Dowfax surfactants, Dow Chemical Company. This additional surfactant is preferably a $C_{6-18}$ alkyl aryl sulfonate.

Especially preferred are $C_{9-18}$ alkyl benzene sulfonates, and most especially preferred are $C_{10-14}$ alkyl benzene sulfonates. An example thereof is Calsoft F-90 (90% active, solid) sodium alkyl benzene sulfonate, available from Pilot Chemical Company. The acidic form of these surfactants, HLAS, may also be appropriate. For example, Biosoft S-130, available from Stepan Chemical Company, may also be suitable for use herein. See also the description of acidic surfactants in Choy et al., U.S. Pat. No. 4,759,867, incorporated herein by reference. Additionally, other surfactants, such as those described in Kirk-Othmer, Encyclopedia of Chemical Technology, 3rd Edition, Volume 22, pp. 332–432 (1983) (which pages are incorporated herein by reference thereto) may be desirable.

5. Hydrolytic Enzymes

Enzymes are especially desirable adjunct materials in these liquid detergents. Unlike aqueous detergents, these substantially nonaqueous detergents may be able to maintain the chemical stability, that is, the activity, of these enzymes markedly better, since water is substantially not present to mediate enzyme decomposition, denaturation or the like.

Proteases are one especially preferred class of enzymes. They are selected from acidic, neutral and alkaline proteases. The terms "acidic," "neutral," and "alkaline," refer to the pH at which the enzymes' activity are optimal. Examples of neutral proteases include Milezyme (available from Miles Laboratory) and trypsin, a naturally occurring protease. Alkaline proteases are available from a wide variety of sources, and are typically produced from various microorganisms (e.g., *Bacillis subtilisin*). Typical examples of alkaline proteases include Maxatase and Maxacal from International BioSynthetics, Alcalase, Savinase and Esperase, all available from Novo Industri A/S. See also Stanislowski et al., U.S. Pat. No. 4,511,490, incorporated herein by reference.

Further suitable enzymes are amylases, which are carbohydrate-hydrolyzing enzymes. It is also preferred to include mixtures of amylases and proteases. Suitable amylases include Rapidase, from Société Rapidase, Milezyme from Miles Laboratory, and Maxamyl from International BioSynthetics.

Still other suitable enzymes are cellulases, such as those described in Tai, U.S. Pat. No. 4,479,881, Murata et al., U.S. Pat. No. 4,443,355, Barbesgaard et al., U.S. Pat. No. 4,435,307, and Ohya et al., U.S. Pat. No. Pat. No. 3,983,082, incorporated herein by reference.

Yet other suitable enzymes are lipases, such as those described in Silver, U.S. Pat. No. 3,950,277, and Thom et al., U.S. Pat. No. 4,707,291, incorporated herein by reference.

The hydrolytic enzyme should be present in an amount of about 0–5%, more preferably 0.01–3%, and most preferably 0.1–2% by weight of the detergent. Mixtures of any of the foregoing hydrolases are desirable, especially protease/amylase blends.

In the invention, it was further discovered that enzymes have an apparent tendency to settle out of the liquid. Therefore, it was desirable to find a material which would assist in stably suspend the enzyme without any deleterious effects on the phase stability or oxidant stability, or the aesthetic appearance of the detergent.

It was discovered that alkanolamines combined with a water soluble or dispersible polymer helped to stably suspend the enzymes, particularly, proteases, in the liquid phase. An exemplary alkanolamine is triethanolamine. Although the alkanolamines are alkaline buffers and could be expected to affect the performance of the peracid, applicants discovered that its actual benefit was as a phase stabilizer for the enzymes. However, in using triethanolamine, it was further discovered that a relatively neat preparation should be used. In preparing detergent formulations containing diethanolamines, it was discovered that even trace amounts of diethanolamines react with the detergent matrix to form an off-color. Thus, triethanolamine ("TEA") is preferred for use as the enzyme stabilizer. However, it also appears that TEA may impair detergency, oxidant and enzyme chemical stability unless used judiciously.

Exemplary water soluble or dispersible polymers could include polyvinyl alcohol, polyvinyl pyrrolidone, hydroxymethyl and hydroxypropyl cellulose, polyacrylic acid (and the copolymers thereof), the esters of polyacrylic and polymethacrylic acid, and polyethylene glycol. In particular, polyethylene glycol ("PEG") of a molecular weight between 1,000–50,000 appears especially preferred. Molecular weights of greater than about 5,000 are greatly preferred. In particular, PEG combined with TEA appears to dramatically improve enzyme suspension by synergistically combining to stabilize the enzyme.

6. Adjuncts

The standard detergent adjuncts can be included in the present invention. These include dyes, such as Monastral blue and anthraquinone dyes (such as those described in Zielske, U.S. Pat. No. 4,661,293, and U.S. Pat. No. 4,746,461). Pigments, which are also suitable colorants, can be selected, without limitation, from titanium dioxide, ultramarine blue (see also, Chang et al., U.S. Pat. No. 4,708,816), and colored aluminosilicates. Fluorescent whitening agents are still other desirable adjuncts. These include the stilbene, styrene, and naphthalene derivatives, which upon being impinged by visible light, emit or fluoresce light at a different wavelength. These FWA's or brighteners are useful for improving the appearance of fabrics which have become dingy through repeated soilings and washings. A preferred FWA is Tinopal CBS-X, from Ciba Geigy A. G. Examples of suitable FWA's can be found in U.K. Patents Nos. 1,298,577, 2,076,011, 2,026,054, 2,026,566, 1,393,042; and U.S. Pat. Nos. 3,951,960, 4,298,290, 3,993,659, 3,980,713 and 3,627,758, incorporated herein by reference. Anti-redeposition agents, such as carboxymethylcellulose, are potentially desirable. Next, foam boosters, such as appropriate anionic surfactants, may be appropriate for inclusion herein. Also, in the case of excess foaming resulting from the use of certain nonionic surfactants, anti-foaming agents, such as alkylated polysiloxanes, e.g., dimethylpolysiloxane would be desirable. Also, certain solvents, such as glycol, e.gs., propylene glycol, and ethylene glycol, certain alcohols, such as ethanol or propanol, and hydrocarbons, such as paraffin oils, e.g., Isopar K from Exxon U.S.A., may be useful to thin these liquid compositions. However, it is again cautioned that the use of solvents is preferably limited. Buffers may also be suitable for use, such as sodium hydroxide, sodium borate, sodium bicarbonate, to maintain a more alkaline pH in aqueous solution, and acids, such as citric acid and boric acid, would be suitable for maintaining or adjusting to a more acidic pH. Buffers, however, may affect stability of the liquid detergent and thus should be used in very minor amounts. Next, if inorganic peroxides have been included, then bleach activators therefor could well be desirable for inclusion herein. This is because the present invention is substantially nonaqueous, and thus, the bleach activators, which are typically esters, may maintain their stability better than in other liquids since they would be less likely to be hydrolyzed in the substantially nonaqueous liquid composition. Suitable examples of appropriate bleach activators may be found in Mitchell et al., U.S. Pat. No. 4,772,290, Fong et al., U.S. Pat. No. 4,964,870, Fong et al., U.S. Pat. No. 4,778,618, Zielske et al., U.S. Pat. No. 4,859,800, Zielske, U.S. Pat. No. 4,957,647, Zielske, U.S. Pat. No. 4,735,740, Chung et al., U.S. Pat. No. 4,412,934, Hardy et al., U.S. Pat. No. 4,681,952, Wevers et al., U.S. Pat. No. 4,087,367, and Hampson et al., U.K. 864,798, all of which are incorporated herein by reference. Lastly, in case the composition is too thin, some thickeners such as gums (xanthan gum and guar gum) and various resins (e.g., polyvinyl alcohol, and polyvinyl pyrrolidone) may be suitable for use. Their use is discrete from the use of water soluble or dispersible resins used as enzyme suspending agents. Fragrances are also desirable adjuncts in these compositions.

The additives may be present in amounts ranging from 0–50%, more preferably 0–40%, and most preferably 0–20%. In certain cases, some of the individual adjuncts may overlap in other categories. For example, some buffers, such as silicates may be also builders. Also, some surface active esters may actually function to a limited extent as surfactants. However, the present invention contemplates each of the adjuncts as providing discrete performance benefits in their various categories.

EXPERIMENTAL

In the following examples, amounts are in wt. %'s of the entire composition unless otherwise specified.

The base formulation is set forth in Example 1. The formulations are prepared by mixing of the ingredients using a stirring plate. Mild heating may be necessary. Additionally, because of inconsistencies per preparation, stock solutions should be prepared.

| Ingredient | Wt. % |
|---|---|
| Neodol 1-5[1] | 83.47 |
| Calsoft F-90[2] | 5.21 |
| Phthalimidopercaproic acid[3] | 7.89 |
| Alcalase 2.5SL[4] | 2.32 |
| Minors (fragrance, dyes) | 0.86 |
| Tinopal CBS-X[5] | 0.25 |
| | 100.00% |

[1]$C_{11}$ ethoxylated alcohol with 5 moles of ethylene oxide per mole of alcohol, from Shell Chemical Company.
[2]$C_{11.5}$ linear alkylbenzene sulfonate, sodium salt (90% active) ("LAS"), from Pilot Chemical Company.
[3]Peracid supplied by Hoechst A.G.
[4]Alkaline protease from Novo Industri A/S.
[5]Fluorescent whitening agent from Ciba-Geigy Corporation.

In the following experiments, the oxidant, enzyme (activity remaining) and phase stability of this formulation was investigated. Oxidant stability is determined using standard thiosulfate titrations using a Brinkman 683 titroprocessor. A solvent, such as isopropanol may be used to aid dissolution of samples. Enzyme analysis is conducted using standard casein method as aided by a $V_{max}$ Microplate Reader connected to an IBM PC-XT personal computer. Phase stability is a visual test conducted against a control.

Surprisingly, excellent results were achieved in all three areas. The results are set forth in Table I below. These results are especially surprising since no stabilizers, either for the peracid or the enzyme were used.

TABLE I

| Storage Temperture | | | |
|---|---|---|---|
| | % A.O. remaining | | |
| OXIDANT STABILITY | 7 days | 14 days | 21 days |
| 70° F. | 91% | 100% | 90% |
| 100° F. | 94% | 103% | 89% |
| 120° F. | 94% | 100% | 85% |
| | % activity remaining | | |
| ENZYME STABILITY | 7 days | 14 days | 28 days |
| 70° F. | 101% | 100% | 102% |
| 100° F. | 95% | 93% | 88% |
| 120° F. | 84% | 65% | 79% |
| | % phase separation | | |
| PHASE STABILITY[1] | 7 days | 14 days | 28 days |
| 70° F. | 28% | 27% | — |
| 100° F. | 20% | 20% | — |

TABLE I-continued

| Storage Temperture | | | |
|---|---|---|---|
| 120° F. | 19% | 18% | — |

[1]Phase separation occurred in the bottom of the measuring vessel.

EXAMPLES 2–5

The base formulation of Example 1 demonstrated settling. Four further formulations emulating Example 1 were prepared. Examples 2–5 were: Example 2 (same as Example 1), Example 3 (without enzyme), Example 4 (without LAS) and Example 5 (without either enzyme or LAS).

Review of the examples after storage at room temperature revealed that the enzyme was the settling material. Accordingly, in later experiments, enzyme suspending aids were investigated.

In the next experiments, applicants attempted to identify and improve enzyme settling concerns.

In order to do this, applicants first determined to raise the pH of the formulation by using an alkanolamine buffer.

EXAMPLE 6

To the initial inventive formulation, 25.89% triethanolamine buffer was added to raise the pH to about 8.5.

| Ingredient | Wt. % |
|---|---|
| Neodol 1-5[1] | 62.13 |
| Calsoft F-90[2] | 3.89 |
| Phthalimidopercaproic acid[3] | 6.19 |
| Triethanolamine | 25.89 |
| Alcalase 2.5SL[4] | 1.72 |
| Tinopal CBS-X[5] | 0.19 |
| | 100.00% |

[1]$C_{11}$ ethoxylated alcohol with 5 moles of ethylene oxide per mole of alcohol, from Shell Chemical Company.
[2]$C_{11.5}$ linear alkylbenzene sulfonate, sodium salt (90% active) ("LAS"), from Pilot Chemical Company.
[3]Peracid supplied by Hoechst A.G.
[4]Alkaline protease from Novo Industri A/S.
[5]Fluorescent whitening agent from Ciba-Geigy Corporation.

In the above Example 6, it was discovered that if 95% triethanolamine with trace amounts of diethanolamine were used, a reddish off-color developed. This was quite surprising and although discolored products are still within the scope of the invention, it is preferred that the liquid detergents of this invention be clear, isotropic liquids. Applicants believe, without being bound to theory, that any diethanolamine present as an impurity in the triethanolamine may react with the imidoperacid to form various colored complexes. Hence, when substantially pure TEA was used, this off-color was largely avoided. Applicants found that TEA with 98.4% and 99% grades were appropriate for this purpose.

EXAMPLE 7

In this example, the following formulation was used. To the initial inventive formulation, triethanolamine and polyethylene glycols ("PEG") of various molecular weights were added.

| Ingredient | Wt. % |
|---|---|
| Neodol 1-5[1] | 61.33 |
| Calsoft F-90[2] | 3.83 |
| Phthalimidopercaproic acid[3] | 6.12 |

-continued

| Ingredient | Wt. % |
|---|---|
| Triethanolamine | 25.55 |
| PEG | 1.28 |
| Alcalase 2.5SL[4] | 1.70 |
| Tinopal CBS-X[5] | 0.19 |
| | 100.00% |

[1]$C_{11}$ ethoxylated alcohol with 5 moles of ethylene oxide per mole of alcohol, from Shell Chemical Company.
[2]$C_{11.5}$ linear alkylbenzene sulfonate, sodium salt (90% active) ("LAS"), from Pilot Chemical Company.
[3]Peracid supplied by Hoechst A.G.
[4]Alkaline protease from Novo Industri A/S.
[5]Fluorescent whitening agent from Ciba-Geigy Corporation.

Various polyethylene glycols were combined with the TEA. It was determined that intermediate to higher molecular weight PEG's were preferred, although lower molecular weight PEG's are still part of the invention. However, the higher molecular weight PEG's had apparent better stability at elevated temperatures (120° F.). This is demonstrated in Table II. In this Table, the formulations are that of Example 7, with the addition of different molecular weight PEG.

TABLE II

| Phase Separation Studies (2 weeks)[1] | | | |
|---|---|---|---|
| Mol. Wt. PEG | Viscosity $t_o$ | Viscosity, 2 wks. | Separation? |
| 1450 | 180 cps | 220 cps | yes |
| 8000 | 310 cps | 280 cps | no |
| 20000 | 270 cps | 340 cps | no |

[1]Viscosity was measured using a Brookfield RVTD Viscometer with a No. 6 spindle at 100 rpm.

EXAMPLES 8–10

After receiving the phase separation results in Table II, applicants tested level effects of the PEG. The base formulation of Example 7 was modified to incorporate 0.5, 0.75 and 1.0 gm/use of PEG 8000 mol. wt. These were stored at room temperature in a short term study. None of the samples separated and only slightly varied in viscosity.

EXAMPLE 11

In this example, the following formulation was used.

| Ingredient | Wt. % |
|---|---|
| Neodol 1-5[1] | 61.33 |
| Calsoft F-90[2] | 3.83 |
| Phthalimido-percaproic acid[3] | 6.12 |
| Triethanolamine | 25.55 |
| PEG 8000[4] | 1.28 |
| Alcalase 2.5SL[5] | 1.70 |
| Tinopal CBS-X[6] | 0.19 |
| | 100.00% |

[1]$C_{11}$ ethoxylated alcohol with 5 moles of ethylene oxide per mole of alcohol, from Shell Chemical Company.
[2]$C_{11.5}$ linear alkylbenzene sulfonate, sodium salt (90% active) ("LAS"), from Pilot Chemical Company.
[3]Peracid supplied by Hoechst A.G.
[4]This level represents 0.75 gm/use.
[5]Alkaline protease from Novo Industri A/S.
[6]Fluorescent whitening agent from Ciba-Geigy Corporation.

Formulations based on Example 11 were then subjected to oxidant, enzyme and phase stability testing. The results are depicted below.

TABLE III

| Storage Temperture | 7 days | 14 days | 28 days |
|---|---|---|---|
| OXIDANT STABILITY | % A.O. remaining | | |
| 70° F. | 78% | 78% | 80% |
| 100° F. | 73% | 71% | 82% |
| 120° F. | 73% | 71% | 67% |
| ENZYME STABILITY | % activity remaining | | |
| 70° F. | 92% | 93% | 90% |
| 100° F. | 84% | 79% | 81% |
| 120° F. | 45% | 35% | 32% |
| PHASE STABILITY[1] | % Syneresis | | |
| 70° F. | 0% | 0% | 0% |
| 100° F. | 0% | 0% | 0% |
| 120° F. | 18% | 25% | 33 |

[1]Initial viscosity was 340 cps.

The invention is further exemplified in the claims which follow. However, the invention is not limited thereby, and obvious embodiments and equivalents thereof are within the claimed invention.

We claim:

1. A stable, liquid, substantially nonaqueous detergent comprising a liquids portion which comprises:

(a) at least one liquid nonionic surfactant selected from the group consisting essentially of $C_{6-18}$ alcohols with 1-15 moles of ethylene oxide per mole of alcohol, $C_{6-18}$ alcohols with 1-10 moles of propylene oxide per mole of alcohol, $C_{6-18}$ alcohols with 1-15 moles of ethylene oxide and 1-10 moles of propylene oxide per mole of alcohol, $C_{6-18}$ alkylphenols with 1-15 moles of ethylene oxide or propylene oxide or both, and mixtures of any of the foregoing polyoxyethylene carboxylic acid esters, fatty acid glycerol esters, fatty acid and ethoxylated fatty acid alkanolamides, block copolymers of propylene oxide and ethylene oxide with propoxylated ethylene diamine or other suitable initiator, amine oxides, phosphine oxides, and sulfoxides and ethoxylated derivatives thereof; and (b) at least one imidoperacid with the structure

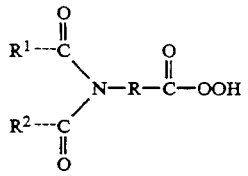

wherein R is $C_{1-20}$ alkylene, $R^1$ and $R^2$ are individually H or $C_{1-6}$ alkyl or alkenyl, or $R^1$ and $R^2$ join to form a heterocycle, said imidoperacid being solubilized in said liquid nonionic surfactant, said imidoperacid being present in an amount sufficient to provide 0.01-100 ppm A.O., the ratio of liquid nonionic surfactant to peracid being from about 20:1 to 1:1.

2. The detergent of claim 1 wherein said imidoperacid is a substituted phthalimidoperacid.

3. The detergent of claim 2 wherein said phthalimidoperacid has the structure

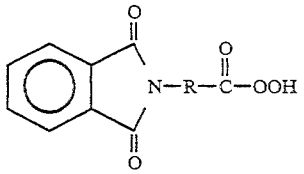

4. The detergent of claim 3 wherein said phthalimidoperacid is phthalimido-peracetic acid, phthalimido-percaproic acid or phthalimido-perdodecanoic acid.

5. The detergent of claim 4 wherein said phthalimidoperacid is phthalimido-percaproic acid.

6. The detergent of claim 1 wherein said nonionic surfactant is selected from the group consisting of $C_{6-18}$ alcohols with 1-15 moles of ethylene oxide per mole of alcohol, $C_{6-18}$ alcohols with 1-10 moles of propylene oxide per mole of alcohol, $C_{6-18}$ alcohols with 1-15 moles of ethylene oxide and 1-10 moles of propylene oxide per mole of alcohol, $C_{6-18}$ alkylphenols with 1-15 moles of ethylene oxide or propylene oxide or both, and mixtures of the foregoing.

7. The detergent of claim 6 wherein said nonionic surfactant has a pour point of less than about 40° C.

8. The detergent of claim 1 further comprising an anionic surfactant.

9. The detergent of claim 8 wherein said anionic surfactant is an anionic sulfate or sulfonate.

10. The detergent of claim 9 wherein said anionic surfactant is an alkyl benzene sulfonate.

11. The detergent of claim 10 wherein said alkyl benzene sulfonate is a $C_{11.5}$ linear alkyl benzene sulfonate.

12. The detergent of claim 1 further comprising a hydrolytic enzyme.

13. The detergent of claim 12 wherein said enzyme is selected from the group consisting of proteases, amylases, lipases, cellulases and mixtures thereof.

14. The detergent of claim 13 wherein the enzyme is a protease.

15. The detergent of claim 13 further including an enzyme suspending agent.

16. The detergent of claim 15 wherein said agent is a combination of an alkanolamine and a water soluble or dispersible polymer.

17. The detergent of claim 16 wherein said alkanolamine is triethanolamine.

18. The detergent of claim 17 wherein said triethanolamine has a purity greater than 95%.

19. The detergent of claim 17 wherein said triethanolamine is substantially free of diethanolamine.

20. The detergent of claim 16 wherein said polymer is polyethylene glycol.

21. The detergent of claim 20 wherein said polyethylene glycol has a molecular weight of 1,000-50,000.

22. The detergent of claim 20 wherein said polyethylene glycol has a molecular weight greater than 5,000.

23. The detergent of claim 1 further comprising 0-50% of a detergent adjunct selected from the group consisting of dyes, pigments, fluorescent whitening agents, anti-redeposition agents, foam boosters, defoaming agents, organic solvents, buffers, builders, additional oxidants, bleach activators, enzyme stabilizers, thickeners, fragrances, and mixtures thereof.

24. The detergent of claim 23 wherein the adjunct is a fluorescent whitening agent.

* * * * *